US009000861B2

(12) United States Patent
Ado et al.

(10) Patent No.: US 9,000,861 B2
(45) Date of Patent: Apr. 7, 2015

(54) POLARIZATION COUPLER

(71) Applicants: Hiroto Ado, Tokyo (JP); Shuji Nuimura, Tokyo (JP); Tomohiro Mizuno, Tokyo (JP); Hidenori Yukawa, Tokyo (JP); Tetsu Owada, Tokyo (JP); Takaaki Kimata, Tokyo (JP)

(72) Inventors: Hiroto Ado, Tokyo (JP); Shuji Nuimura, Tokyo (JP); Tomohiro Mizuno, Tokyo (JP); Hidenori Yukawa, Tokyo (JP); Tetsu Owada, Tokyo (JP); Takaaki Kimata, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 14/238,658

(22) PCT Filed: Nov. 16, 2012

(86) PCT No.: PCT/JP2012/079807

§ 371 (c)(1),
(2) Date: Feb. 12, 2014

(87) PCT Pub. No.: WO2013/073674

PCT Pub. Date: May 23, 2013

(65) Prior Publication Data

US 2014/0197908 A1 Jul. 17, 2014

(30) Foreign Application Priority Data

Nov. 17, 2011 (JP) ..... 2011-251663

(51) Int. Cl.

| | |
|---|---|
| ***H01P 1/17*** | (2006.01) |
| ***H01P 3/127*** | (2006.01) |
| ***H01P 1/161*** | (2006.01) |
| ***H01P 1/213*** | (2006.01) |
| ***H01P 5/08*** | (2006.01) |

(52) U.S. Cl.

CPC ..... *H01P 3/127* (2013.01); *H01P 1/161* (2013.01); *H01P 1/2131* (2013.01); *H01P 5/082* (2013.01)

(58) Field of Classification Search

USPC ..... 333/21 A

See application file for complete search history.

(56) References Cited

U.S. PATENT DOCUMENTS 5,392,008 A 2/1995 Wong

FOREIGN PATENT DOCUMENTS

| | | |
|---|---|---|
| JP | 56-90601 | 7/1981 |
| JP | 01-273401 | 11/1989 |
| JP | 03-253101 | 11/1991 |
| JP | 06-140810 | 5/1994 |
| JP | 07-94905 | 4/1995 |
| JP | 08-162804 | 6/1996 |
| JP | 09-186506 | 7/1997 |

OTHER PUBLICATIONS

International Search Report issued Feb. 12, 2013, in PCT/JP12/079807 filed Nov. 16, 2012.

*Primary Examiner* — Daniel Rojas

(74) *Attorney, Agent, or Firm* — Oblon, McClelland, Maier & Neustadt, L.L.P.

(57) ABSTRACT

A polarization coupler includes: connector waveguide that connects circular waveguide with quadrangular waveguide arranged in an axial direction of circular waveguide and having short side shorter than an inner diameter of circular waveguide; flat conductor wall formed over connector and circular waveguides, and dividing the inside of connector and circular waveguides arranged parallel to an extending direction of long side of quadrangular waveguide; first inclined surface formed on inner wall of connector waveguide at a position facing one surface of conductor wall, and inclined toward conductor wall as coming closer to quadrangular waveguide; second inclined surface formed on the inner wall of connector waveguide at a position facing the other surface of conductor wall, and inclined toward conductor wall as coming closer to quadrangular waveguide; and coupling hole, formed in circular waveguide, for extracting one polarization-divided by conductor wall out of electromagnetic waves propagated through circular waveguide.

15 Claims, 12 Drawing Sheets

POLARIZATION COUPLER

TECHNICAL FIELD

The present invention relates to a polarization coupler used for mainly separating orthogonally polarized waves in a VHF band, a UHF band, a microwave band, a millimetric wave band, and so on.

BACKGROUND ART

Conventionally, in an orthogonal polarization coupler, there is disclosed the one having: a circular main waveguide that transmits orthogonally polarized waves; a coupling hole which is radially provided in order to branch the circular main waveguide; a rectangular sub waveguide that extracts a vertical component electromagnetic wave of the orthogonally polarized waves in the orthogonal direction of the circular main waveguide via the coupling hole; a rectangular sub waveguide that extracts a horizontal component electromagnetic wave of the orthogonally polarized waves in the coaxial direction of the circular main waveguide; a step conversion part for matching the coaxial rectangular sub waveguide with the circular main waveguide; and a septum plate (short circuit plate) that is provided parallel to the horizontal component of the orthogonal polarized waves, and formed in the circular main waveguide on a side closer to the coaxial rectangular sub waveguide with respect to the coupling hole of the circular main waveguide, or a septum plate (short circuit plate) that is provided parallel to the horizontal component of the orthogonal polarized waves, and formed in the step conversion part (e.g., see Patent Documents 1 to 3).

In the orthogonal polarization coupler described in Patent Documents 1 to 3, the orthogonal polarized waves transmitted through the circular main waveguide are branched in the coaxial direction and the orthogonal direction by the septum plate. The polarized wave component parallel to the septum plate is reflected by the septum plate, and extracted in the orthogonally branched rectangular sub waveguide via the coupling hole. On the other hand, the polarized wave of the vertical component orthogonal to the septum plate is extracted from the coaxial rectangular sub waveguide via the step conversion part without receiving much influence of the septum plate. At this time, the step conversion part performs mode conversion from the mode of the circular main waveguide to the mode of the rectangular sub waveguide.

In such an orthogonal polarization coupler, when the polarized wave whose component is orthogonal to the septum plate is extracted, a part of radio waves is reflected on the end of the septum plate, and a part of the reflected radio waves is further reflected on the end of the septum plate on the reversed side. Then, these waves that are subjected to multiple reflection at a certain frequency sometimes overlap and intensify each other, and confine these energies in the section of the septum plate. In such a case, as a result, the radio waves extracted from the rectangular waveguide causes periodic resonance called plate resonance. The frequency at which this periodic and plate resonance occurs depends on the length of the septum plate in the coaxial direction. Therefore, in the orthogonal polarization coupler, in order to effectively extract energy in a desired band, it is necessary to adjust the length of the septum plate.

PRIOR ART DOCUMENTS

Patent Documents

Patent Document 1: Japanese Patent Application Laid-open No. H1-273401 (full text, FIG. 1 and FIG. 2)

Patent Document 2: Japanese Patent Application Laid-open No. H6-140810 (paragraph 0005, and FIG. 5)

Patent Document 3: Japanese Patent Application Laid-open No. H8-162804 (paragraph 0002 to 0004, and FIG. 4)

SUMMARY OF THE INVENTION

Problems to be Solved by the Invention

However, the polarization coupler described in each of Patent Documents 1 to 3 has a problem that the step conversion part connected to the circular main waveguide becomes a waveguide with a different diameter, to cause a step (level difference) on a side wall with respect to the circular main waveguide, and the septum plate is arranged either on the circular main waveguide side or on the step conversion part side, and therefore an adjustment margin for adjusting the length of the septum plate is extremely small, so that a desired performance is not obtained.

In the polarization coupler described in each of Patent Documents 1 and 2, the septum plate is arranged on the circular main waveguide side, and therefore when the length of the septum plate is increased while avoiding a step part between the circular main waveguide side and the step conversion part, the length of the circular main waveguide is increased by the length of the septum plate, resulting an axially elongated large structure.

In the polarization coupler described in Patent Document 3, the septum plate is arranged on the step conversion part that connects the rectangular sub waveguide on the coaxial side connected to the circular main waveguide, and therefore the range where the length of the septum plate can be increased while avoiding the step part between the circular main waveguide side and the step conversion part depends on the length of the step conversion part.

In the polarization coupler described in Patent Document 3, the septum plate is placed on the step conversion part separated from the coupling hole, and therefore when the polarized wave whose component is parallel to the septum plate is extracted, the radio waves that directly enter the rectangular sub waveguide on the orthogonal side via the coupling hole from the circular main waveguide, and the radio waves that are reflected on the septum plate and thereafter enter the orthogonal-side rectangular sub waveguide via the coupling hole are greatly different in phase from each other, thereby making it difficult to attain matching in a wide band.

In order to arrange the septum plate that extends over the step part between the circular main waveguide side and the step conversion part, there is a problem such that the number of machining works in manufacturing the polarization coupler increases. Additionally, there is also a case such that the machining work itself is sometimes difficult. Further, even when the following work can be performed: the septum plate that extends over the step part between the circular main waveguide side and the step conversion part is disposed, there is another problem that the step part between the circular main waveguide side and the step conversion part, and the septum plate are not adhered, so that a desired performance is not obtained, or on the contrary, an unnecessary conductor remains, so that a desired performance is not obtained.

The present invention is made to solve the aforementioned problems, and an object of the invention is to provide a polarization coupler that has an axially small structure, is easily machined, is highly receptive with respect to the length of the septum plate, and is capable of achieving excellent characteristics in each of two polarized waves orthogonal to each other.

Means for Solving the Problem

A polarization coupler according to an aspect includes: a circular waveguide; a quadrangular waveguide that is arranged in an axial direction of the circular waveguide, and has a short side shorter than an inner diameter of the circular waveguide; a connector waveguide that connects the quadrangular waveguide with the circular waveguide; a flat conductor wall that is formed over the connector waveguide and the circular waveguide, and divides the inside of the connector waveguide and the circular waveguide arranged parallel to a direction where a long side of the quadrangular waveguide extends; a first inclined surface that is formed on an inner wall of the connector waveguide at a position facing one surface of the conductor wall, and inclined toward the conductor wall as coming closer to the quadrangular waveguide; a second inclined surface that is formed on the inner wall of the connector waveguide at a position facing the other surface of the conductor wall, and inclined toward the conductor wall as coming closer to the quadrangular waveguide; and a coupling hole that is formed in the circular waveguide, and extracts one that is polarization-divided by the conductor wall out of electromagnetic waves propagated through the circular waveguide, wherein the connector waveguide is configured by: an arc-shaped first wall surface; an arc-shaped second wall surface that faces the first wall surface; the first inclined surface; and the second inclined surface.

A polarization coupler according to the invention of claim 2 is the polarization coupler according to claim 1, wherein the first inclined surface and the second inclined surface each have a stepwise shape.

In a polarization coupler according to another aspect, the connector waveguide is configured by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface.

In a polarization coupler according to another aspect, the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein the first wall surface and the second wall surface each have a diameter that increases from the circular waveguide side toward the quadrangular waveguide side.

In a polarization coupler according to another aspect, the long side of the quadrangular waveguide is shorter than the inner diameter of the circular waveguide.

In a polarization coupler according to another aspect, the one surface and the other surface of the conductor wall in the connector waveguide each are formed in a trapezoid shape.

In a polarization coupler according to another aspect, the connector waveguide is configured at a part connected to the circular waveguide by: an arc-shaped first wall surface; an arc-shaped second wall surface that faces the first wall surface; the first inclined surface; and the second inclined surface, wherein a distance between the first wall surface and the second wall surface decreases from the circular waveguide side toward the quadrangular waveguide side.

In a polarization coupler according to another aspect, the connector waveguide is configured at a part connected to the circular waveguide by: an arc-shaped first wall surface; an arc-shaped second wall surface that faces the first wall surface; the first inclined surface; and the second inclined surface, wherein a distance between the first wall surface and the second wall surface decreases from the circular waveguide side toward the quadrangular waveguide side.

In a polarization coupler according to another aspect, the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein a distance between the first wall surface and the second wall surface decreases from the circular waveguide side toward the quadrangular waveguide side.

In a polarization coupler according to another aspect, the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein a distance between the first wall surface and the second wall surface decreases from the circular waveguide side toward the quadrangular waveguide side.

In a polarization coupler according to another aspect, the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein a distance between the first wall surface and the second wall surface decreases, and also the first wall surface and the second wall surface each have a diameter that increases, from the circular waveguide side toward the quadrangular waveguide side.

In a polarization coupler according to another aspect, the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein a distance between the first wall surface and the second wall surface decreases, and also the first wall surface and the second wall surface each have a diameter that increases, from the circular waveguide side toward the quadrangular waveguide side.

In a polarization coupler according to another aspect, the conductor wall is formed on the first wall surface and the second wall surface, and divides the inside of the connector waveguide.

In a polarization coupler according to another aspect, the conductor wall is formed on the first wall surface and the second wall surface, and divides the inside of the connector waveguide.

In a polarization coupler according to another aspect, the conductor wall is formed on the first wall surface and the second wall surface, and divides the inside of the connector waveguide.

In a polarization coupler according to another aspect, the conductor wall is formed on the first wall surface and the second wall surface, and divides the inside of the connector waveguide.

In a polarization coupler according to another aspect, the conductor wall is formed on the first wall surface and the second wall surface, and divides the inside of the connector waveguide.

In a polarization coupler according to another aspect, the conductor wall is formed on the first wall surface and the second wall surface, and divides the inside of the connector waveguide.

In a polarization coupler according to another aspect, the conductor wall is formed on the first wall surface and the second wall surface, and divides the inside of the connector waveguide.

In a polarization coupler according to another aspect, the conductor wall is formed on the first wall surface and the second wall surface, and divides the inside of the connector waveguide.

In a polarization coupler according to another aspect, the conductor wall is formed integrally with the circular waveguide and the quadrangular waveguide.

In a polarization coupler according to another aspect, the quadrangular waveguide has a long side longer than the inner diameter of the circular waveguide, and a distance between the first wall surface and the second wall surface of the connector waveguide increases from the circular waveguide side to the quadrangular waveguide.

In a polarization coupler according to another aspect, the quadrangular waveguide has a long side longer than the inner diameter of the circular waveguide, and at a part where the connector waveguide is connected with the circular waveguide, the first wall surface and the second wall surface each are formed in an arc-shape having the same diameter as the inner diameter of the circular waveguide, and a distance between the first wall surface and the second wall surface increases from the circular waveguide side to the quadrangular waveguide.

Effect of the Invention

As described above, according to the invention of claim 1, it is possible to obtain a polarization coupler, in which the easiness in the adjustment or workability of the conductor wall (septum plate) for obtaining desired electric performance is secured, so that the septum plate is easily provided in production, and the range where the length of the septum plate can be adjusted becomes wider, so that an improvement in electric performance such as bandwidth widening can be achieved, and that a step is unlikely to be generated inside the waveguide at the connecting portion between the circular waveguide and the connector waveguide part.

According to the invention of claim 2, in addition to the effect of the invention of claim 1, the inclined shape of each of the first inclined surface and the second inclined surface of the connector waveguide is the stepwise shape, and hence it is possible to obtain a polarization coupler that is further easily processed.

According to aspects of the invention, it is possible to obtain a polarization coupler, in which a step is not generated on the connecting portion between the circular waveguide and the connector waveguide inside the waveguide.

According to aspects of the invention, it is possible to obtain a polarization coupler, in which a step is not generated on the connecting portion between the circular waveguide and the connector waveguide inside the waveguide, and the connector waveguide has high affinity with the sectional shape of the quadrangular waveguide.

According to aspects of the invention, it is possible to obtain a polarization coupler that has the connector waveguide having high affinity with the sectional shape of the quadrangular waveguide with a long side shorter than the inner diameter of the circular waveguide.

According to aspects of the invention, it is possible to obtain a polarization coupler, in which the conductor wall does not have a step on the connecting portion between the circular waveguide and the connector waveguide.

According to aspects of the invention, it is possible to obtain a polarization coupler, in which a step is not generated inside the waveguide on the connecting portion between the circular waveguide and the connector waveguide.

According to aspects of the invention, it is possible to obtain a polarization coupler, in which a step is not generated inside the waveguide on the connecting portion between the circular waveguide and the connector waveguide.

According to aspects of the invention, it is possible to obtain a polarization coupler that has the connector waveguide having high affinity with the quadrangular waveguide having a long side shorter than the inner diameter of the circular waveguide.

According to aspects of the invention, it is possible to obtain a polarization coupler that has the connector waveguide having high affinity with the quadrangular waveguide having a long side shorter than the inner diameter of the circular waveguide.

According to aspects of the invention, it is possible to obtain a polarization coupler that has the connector waveguide having high affinity with the sectional shape of the quadrangular waveguide with a long side shorter than the inner diameter of the circular waveguide.

According to aspects of the invention, it is possible to obtain a polarization coupler that has the connector waveguide having high affinity with the sectional shape of the quadrangular waveguide with a long side shorter than the inner diameter of the circular waveguide.

According to aspects of the invention, it is possible to obtain a polarization coupler, in which the conductor wall is further easily formed over the connector waveguide and the circular waveguide.

According to aspects of the invention, it is possible to obtain a polarization coupler having the conductor of a flate plate having a rectangular shape with a trapezoid shape, instead of the flat plate having a stepped outer shape.

According to aspects of the invention, it is possible to obtain a polarization coupler having a flate plate having a shape combining a rectangular shape with a trapezoid shape, instead of the flat plate having a stepped outer shape.

BEST MODE FOR CARRYING OUT THE INVENTION

In the following, in order to explain the present invention in more detail, embodiments for carrying out the invention will be described with reference to the accompanying drawings.

Embodiment 1.

Figure 1:
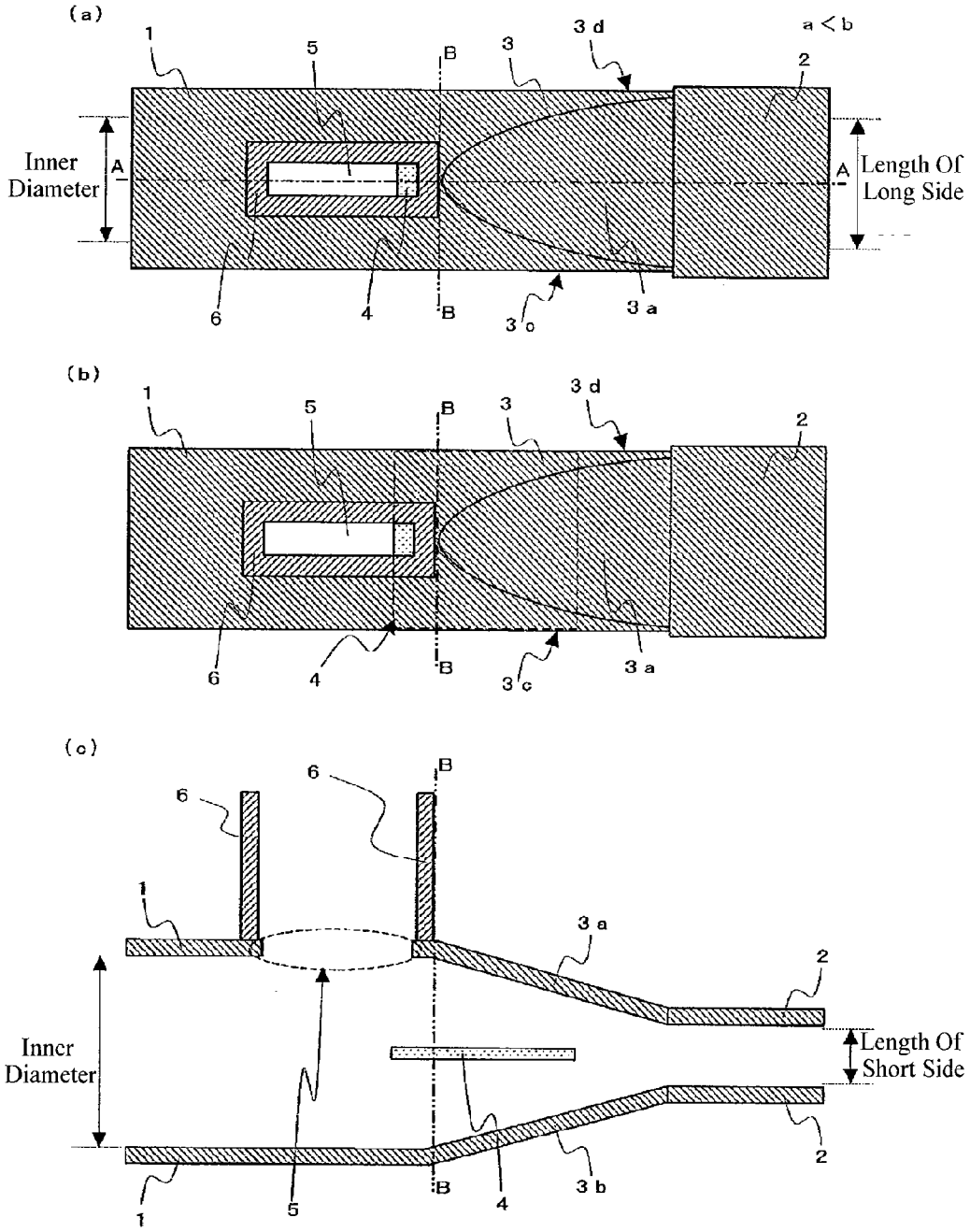
FIG. 1 is a configuration diagram of a polarization coupler according to Embodiment 1 of this invention.

Hereinafter, Embodiment 1 of this invention will described with reference to FIG. 1 to FIG. 7. FIG. 1(*a*) is a top view of a polarization coupler, FIG. 1(*b*) is a top view of the polarization coupler (representing a conductor wall (septum plate) by a dotted line), FIG. 1(*c*) is a sectional view of the polarization coupler taken along the dashed line AA shown in FIG. 1(*a*), and the chain double-dashed line BB in FIG. 1 indicates a boundary in function between a circular waveguide and a connector waveguide. FIG. 3(*a*) is a perspective side view (representing the conductor wall (septum plate) by a dotted line) of the polarization coupler, and FIG. 3(*b*) is a side view of the polarization coupler as viewed along the arrow B shown in FIG. 3(*a*). In the figures, the same reference numerals denote the same or corresponding parts, and detailed description thereof will be omitted.

Figure 5:
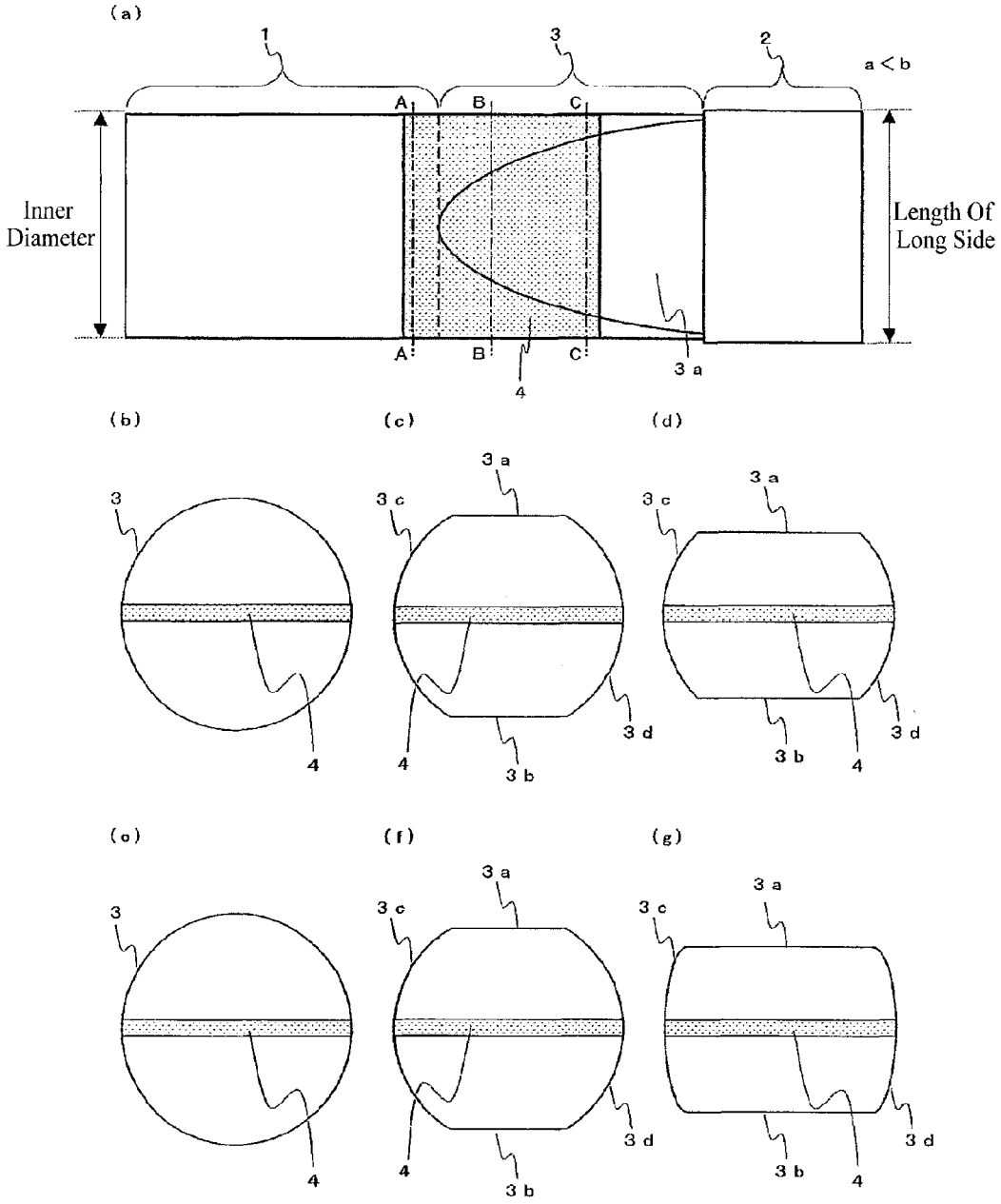
FIG. 5 is a perspective top view and sectional views of the polarization coupler according to Embodiment 1 of this invention.
Figure 6:
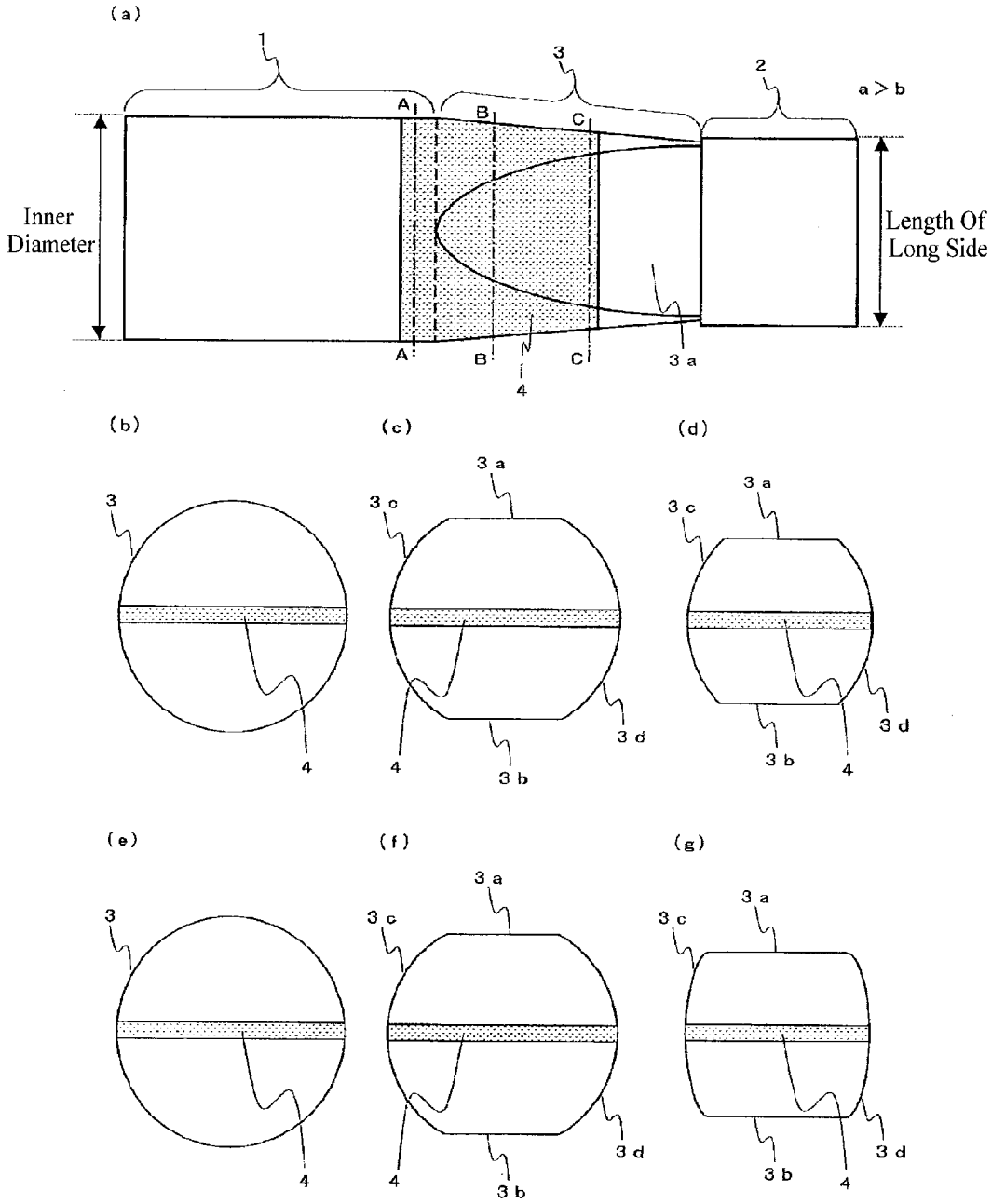
FIG. 6 is a perspective top view and sectional views of the polarization coupler according to Embodiment 1 of this invention.
Figure 7:
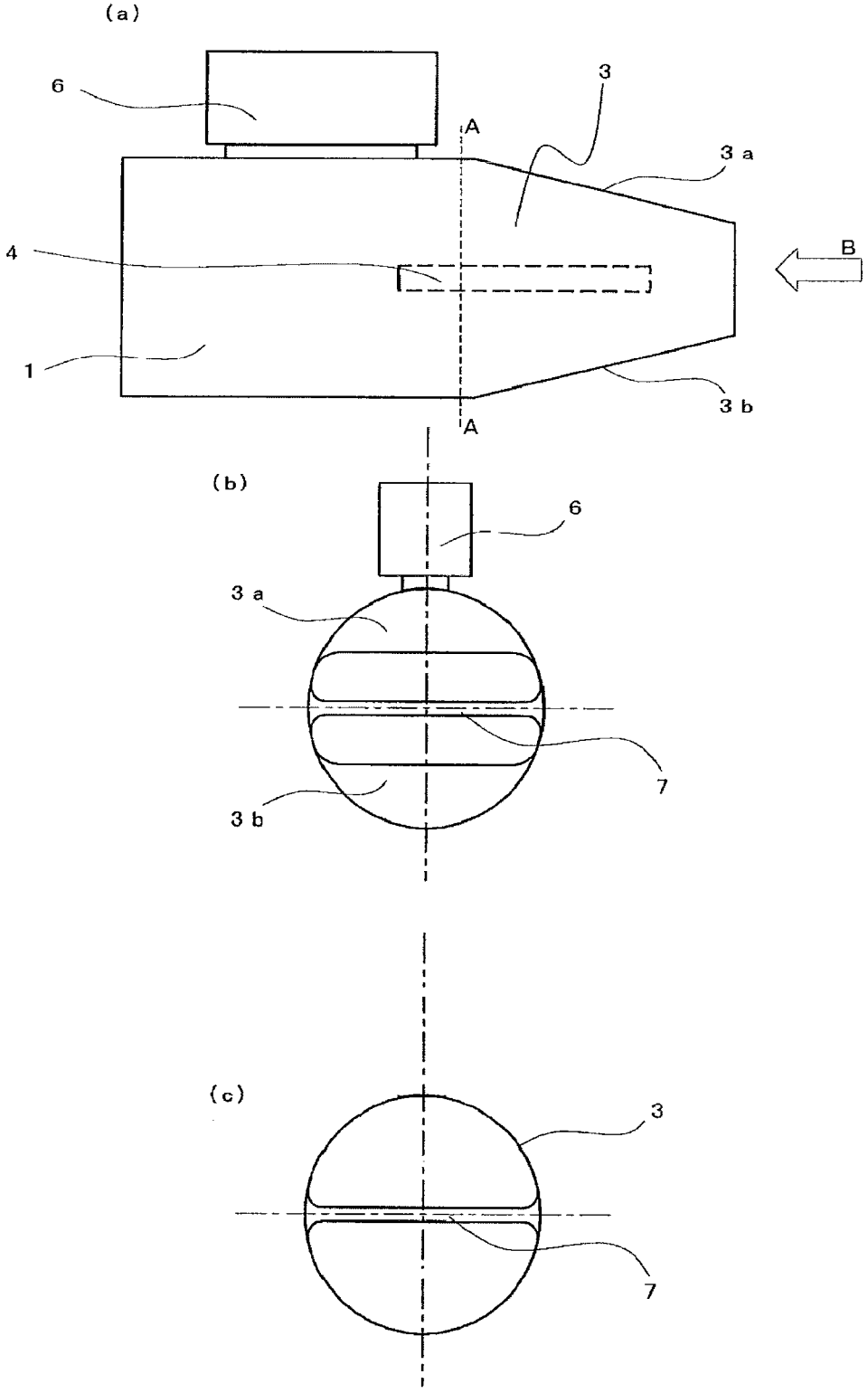
FIG. 7 is a perspective side view, a side view, and a sectional view of the polarization coupler according to Embodiment 1 of this invention.

FIG. 5(*a*) is a perspective top view (omitting a coupling hole and a quadrangular sub waveguide) of the polarization coupler; FIGS. 5(*b*) and 5(*e*) are sectional views of the polarization coupler taken along the dashed line AA shown in FIG. 5(*a*); FIGS. 5(*c*) and 5(*f*) are sectional views of the polarization coupler taken along the dashed line BB shown in FIG. 5(*a*); FIGS. 5(*d*) and 5(*g*) are sectional views of the polarization coupler taken along the dashed line CC shown in FIG. 5(*a*). FIG. 6(*a*) is a perspective top view (omitting the coupling hole and the quadrangular sub waveguide) of the polarization coupler; FIGS. 6(*b*) and 6(*e*) are sectional views of the polarization coupler taken along the dashed line AA shown in FIG. 6(*a*); FIGS. 6(*c*) and 6(*f*) are sectional views of the polarization coupler taken along the dashed line BB shown in FIG. 6(*a*); FIGS. 6(*d*) and 6(*g*) are sectional views of the polarization coupler taken along the dashed line CC shown in FIG. 6(*a*). FIG. 7(*a*) is a perspective side view (representing the conductor wall (septum plate) by a dotted line) of the polarization coupler; FIG. 7(*b*) is a side view of the polarization coupler as viewed along the arrow B shown in FIG. 7(*a*); and FIG. 7(*c*) is a sectional view of the polarization coupler taken along the dotted line AA shown in FIG. 7(*a*). In the figures, the same reference numerals denote the same or corresponding parts, and detailed description thereof will be omitted.

In FIG. 1 to FIG. 7, reference numeral 1 denotes a circular waveguide (circular main waveguide); 2 denotes a quadrangular waveguide (a rectangular waveguide, a quadrangular (square) main waveguide, a rectangular main waveguide, or a coaxial-side quadrangular sub waveguide) that is arranged in an axial direction (coaxial direction) in which the circular waveguide 1 extends, and has a short side shorter than the inner diameter of the circular waveguide 1; 3 denotes a connector waveguide that connects the quadrangular waveguide 2 with the circular waveguide 1; 4 denotes a flat conductor wall (a septum plate or a short circuit plate) that is formed over the connector waveguide 3 and the circular waveguide 1, and divides the inside of the connector waveguide 3 and the circular waveguide 1 arranged in parallel to a direction in which the long side of the quadrangular waveguide 2 extends; 3*a* denotes a first inclined surface that is formed on the inner wall of the connector waveguide 3 at a position facing one surface of the conductor wall (septum plate) 4, and inclined toward the conductor wall 4 as coming closer to the quadrangular waveguide 2; and 3*b* denotes a second inclined surface that is formed on the inner wall of the connector waveguide 3 at a position facing the other surface of the conductor wall (septum plate) 4, and inclined toward the conductor wall 4 as coming closer to the quadrangular waveguide 2. In the figures, the same reference numerals denote the same or corresponding parts, and detailed description thereof will be omitted.

Note that in FIG. 1 to FIG. 3, FIG. 5 and FIG. 7, the circular waveguide 1 has a substantially perfect circular shape, and a constant inner diameter over the circumference, and the length of the long side of the quadrangular waveguide 2 is substantially the same as the inner diameter of the circular waveguide 1, or longer than the inner diameter of the circular waveguide 1 (In the connector waveguide 3, the inner diameter corresponds to the inner diameter of the part other than the first inclined surface 3*a* and the second inclined surface 3*b*. In other words, the inner diameter corresponds to a diameter related to a first wall surface 3*c* and a second wall surface 3*d* described later). Thus, it is assumed that when the inner diameter of the circular waveguide 1 is denoted by a, and the long side of the quadrangular waveguide 2 is denoted by b, $b=a+\alpha$ is satisfied. In this case, as long as the connection between the circular waveguide 1 (connector waveguide 3) and the quadrangular waveguide 2 is hindered, any value of a may be employed. Of course, as illustrated in FIG. 4, the circular waveguide 1 may have a substantially perfect circular shape, and a constant inner diameter over the circumference, and the length of the long side of the quadrangular waveguide 2 is substantially the same as the inner diameter of the circular waveguide 1, or shorter than the inner diameter of the circular waveguide 1 (In the connector waveguide 3, the inner diameter corresponds to the inner diameter of the part other than the first inclined surface 3*a* and the second inclined surface 3*b*. In other words, the inner diameter corresponds to the diameter related to the first wall surface 3*c* and the second wall surface 3*d* described later). That is, it is assumed that when the inner diameter of the circular waveguide 1 is denoted by a, and the long side of the quadrangular waveguide 2 is denoted by b, $b+\alpha=a$ is satisfied. The definition of a is the same as the foregoing one. However, in a case where $\alpha$ exceeds a permissible range, as illustrated in FIG. 6, the parts of the first wall surface 3*c* and the second wall surface 3*d* (described later) in the connector waveguide 3 should be formed in an inclined shape. In FIG. 6, in the diameter related to the first wall surface 3*c* and the second wall surface 3*d* (described later) in the connector waveguide 3, there is shown the diameter of the part in contact with the quadrangular waveguide 2 or the diameter of the part near the quadrangular waveguide 2 is shorter than the length of the long side of the quadrangular waveguide 2. Though it may be reversed, a difference therebetween is required to be within the aforementioned range of α. A case where the circular waveguide 1 is an ellipse will be described later. In the figures, the same reference numerals denote the same or corresponding parts, and detailed description thereof will be omitted.

Subsequently, in FIG. 1 to FIG. 7, reference numeral 5 denotes a coupling hole formed in the circular waveguide 1 and provided in the radial direction of the circular waveguide 1 to branch the circular waveguide 1 in order to extract one that is polarization-divided by the conductor wall 4 out of electromagnetic waves propagated through the circular waveguide 1. The coupling hole 5 is formed at a position facing a part of one or the other surface of the conductor wall 4. Reference numeral 6 denotes a quadrangular sub waveguide (a rectangular sub waveguide, or an orthogonal-side rectangular sub waveguide) that extracts the electromagnetic waves in the orthogonal direction of the circular main waveguide via the coupling hole 5; 3*c* denotes an arc-shaped first wall surface that configures the connector waveguide 3; and 3*d* denotes an arc-shaped second wall surface that configures the connector waveguide 3, and faces the first wall surface 3*c*. The first wall surface 3*c* and the second wall surface 3*d* face each other in a state where the sides closer to the centers of the arcs thereof face each other. Note that the connector waveguide 3 is configured by the first wall surface 3*c*, the arc-shaped second wall surface 3*d* that faces the first wall surface 3*c*, the first inclined surface 3*a*, and the second inclined surface 3*b*.

The conductor wall 4 is formed on the first wall surface 3*c* and the second wall surface 3*d* to thus divides the inside of the connector waveguide 3. By the conductor wall 4, the first wall surface 3*c*, and the second wall surface 3*d*, the connector waveguide 3 is formed in an H-shape. Further, by adding the first inclined surface 3*a* and the second inclined surface 3*b* thereto, the connector waveguide 3 is formed in a θ shape. In the figures, the same reference numerals denote the same or corresponding parts, and detailed description thereof will be omitted. In the figures other than FIG. 1, since easy understanding of the structure or the positional relation (particularly, the inner wall structure of the waveguide structure of the polarization coupler according to Embodiment 1) is given priority, the conductor thicknesses of the circular waveguide 1, the quadrangular waveguide 2, the connector waveguide 3, and the quadrangular sub waveguide 6 are represented by segments.

Figure 2:
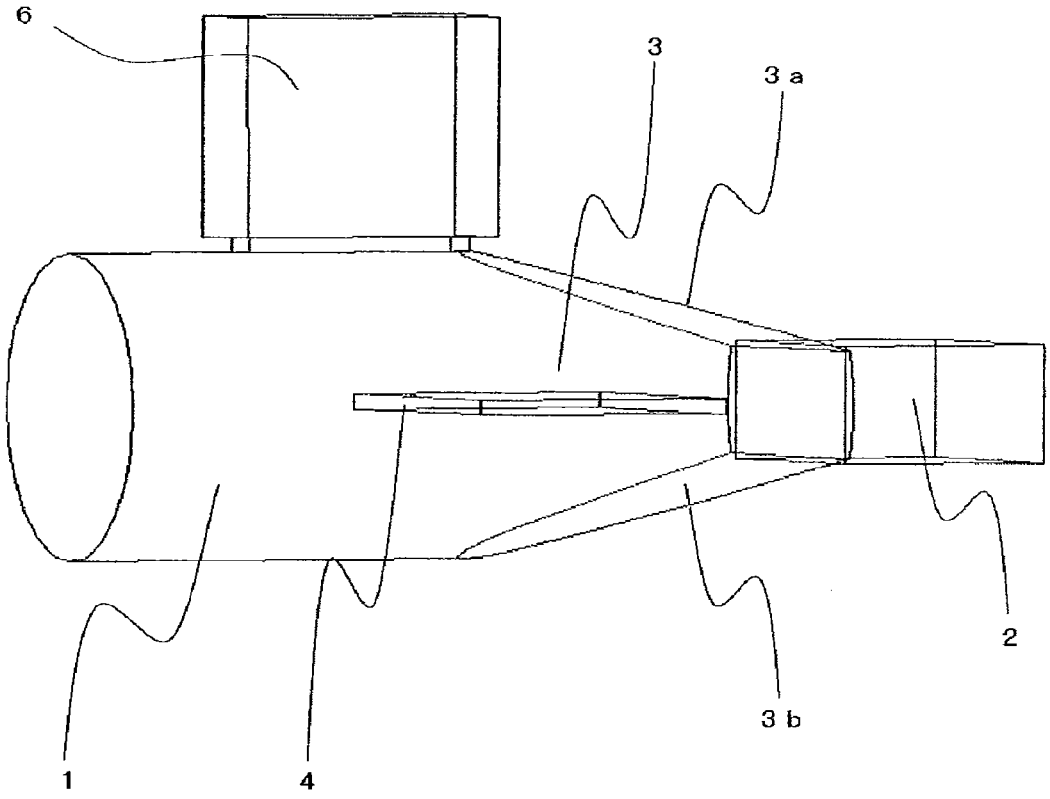
FIG. 2 is a perspective view (single view drawing) of the polarization coupler according to Embodiment 1 of this invention.
Figure 3:
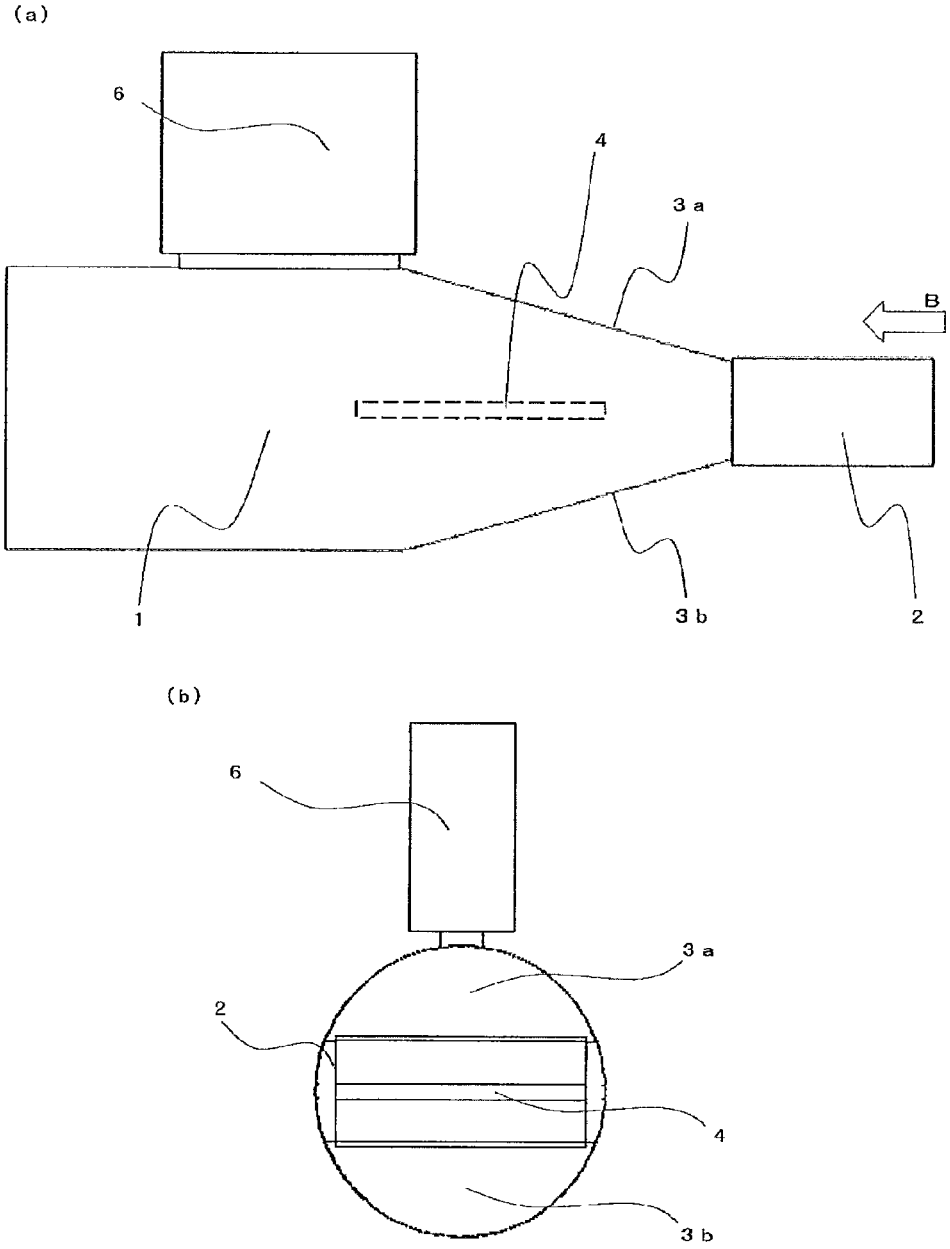
FIG. 3 is a perspective side view and a side view of the polarization coupler according to Embodiment 1 of this invention.
Figure 4:
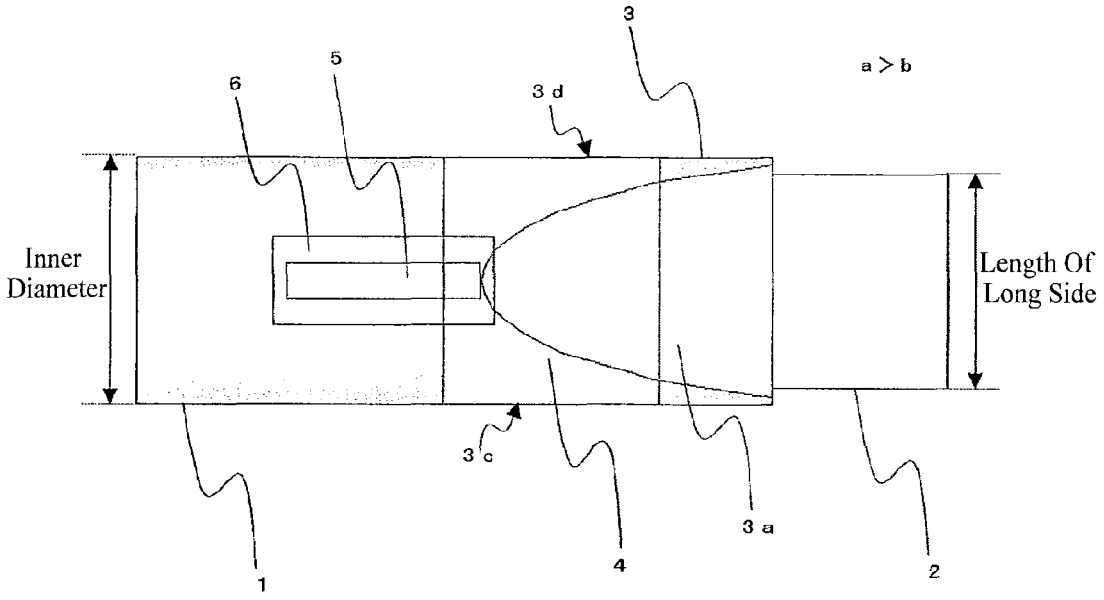
FIG. 4 is a perspective top view of the polarization coupler according to Embodiment 1 of this invention.

With reference to FIG. 1 to FIG. 5, the polarization coupler according to Embodiment 1 will be described. FIG. 1 to FIG. 3 each show the circular waveguide 1 that is connected to the connector waveguide 3 having the first inclined surface 3*a* and the second inclined surface 3*b* formed in a hyperbolic outer shape such that an oval form is divided in the coaxial direction. Though the first inclined surface 3*a* and the second inclined surface 3*b* each are a surface having a linear inclination (taper), the taper (inclination) may have a curved shape defined by a trigonometric function such as a cosine and a sine instead of a linear shape. The connector waveguide 3 is connected to the quadrangular waveguide 2. In addition, the circular waveguide 1 is provided with the coupling hole 5 in the orthogonal direction, and the coupling hole 5 is connected to the quadrangular sub waveguide 6.

The conductor wall 4 is arranged inside the waveguide (waveguide structure of the polarization coupler according to Embodiment 1) extending over from the circular waveguide 1 to the connector waveguide 3. Note that from FIG. 1 to FIG. 3, it is found that the coupling hole 5 is formed at a position facing a part of one (the other) surface of the conductor wall 4. The part of the conductor wall 4 can be seen from an opening of the quadrangular sub waveguide 6 illustrated in each of the FIGS. 1(*a*) and 1(*b*). Similarly, from an opening of the quadrangular waveguide 2 illustrated in FIG. 3(*b*), the conductor wall 4 can be seen to extend in a direction where the long side of the quadrangular waveguide 2 extends, and in the direction orthogonal to a direction where the short side of the quadrangular waveguide 2 extends.

Next, with reference to FIG. 4 and FIG. 5 (FIG. 1(*b*)), a description will be given of the first wall surface 3*c* and the second wall surface 3*d* that are side walls that connect the first inclined surface 3*a* and the second inclined surface 3*b* of the connector waveguide 3. Note that in the polarization coupler illustrated in FIG. 4, the inner diameter (a) of the circular waveguide 1 is longer than the length (b) of the long side of the quadrangular waveguide 2. In the polarization coupler illustrated in FIG. 5, the inner diameter (a) of the circular waveguide 1 is shorter than the length (b) of the long side of the quadrangular waveguide 2. First, from FIG. 1(*b*), FIG. 4 and FIG. 5(*a*), it is understood that the conductor wall 4 has one surface and the other surface whose shapes are rectangular shapes. That is, it is understood that in the waveguide structure of the polarization coupler according to Embodiment 1, the conductor wall 4 is not a flat plate having a stepped outer shape. The structures and shapes of the first wall surface 3*c* and the second wall surface 3*d* contributes to the above performance. From FIG. 4, FIG. 5(*a*) and FIGS. 5(*b*) to 5(*d*), it is understood that the connector waveguide 3 has an oval sectional-shape formed by cutting out the upper and lower parts of the circle (circular waveguide 1) shown in FIG. 5(*b*) along parallel lines, and an interval between the upper and lower parallel lines varies while keeping the same diameter as that of the circular waveguide 1 (FIGS. 5(*c*) and 5(*d*)).

That is, from FIG. 4, FIG. 5(*a*) and FIGS. 5(*b*) to 5(*d*), it can be said that the connector waveguide 3 is configured by: the arc-shaped first wall surface 3*c* corresponding to the same diameter as the inner diameter of the circular waveguide 1; the arc-shaped second wall surface 3*d* that faces the first wall surface 3*c* and corresponds to the same diameter as the inner diameter of the circular waveguide 1; the first inclined surface 3*a*; and the second inclined surface 3*b*.

Accordingly, the conductor wall 4 is formed over the connector waveguide 3 and the circular waveguide 1 in a manner to bridge the centers of the facing arcs of the first wall surface 3*c* and the second wall surface 3*d* (connect the centers of the arcs), so that the conductor wall 4 can have a flat plate having a rectangular shape instead of the one having a stepped outer shape.

Though in FIGS. 5(*b*) to 5(*d*), there is described the configuration in which the first wall surface 3*c* and the second wall surface 3*d* have the same shape along the coaxial direction, a description will be given of a case where the conductor wall 4 can be formed in the plate having the rectangular shape instead of the one having a stepped outer shape, even when the wall surfaces are formed over the connector waveguide 3 and circular waveguide 1, not having the same shape along the coaxial direction, with reference to FIG. 4, FIG. 5(*a*) and FIGS. 5(*e*) to 5(*g*).

In FIGS. 5(*e*) to 5(*g*), the connector waveguide 3 is configured at a part connected to the circular waveguide 1 by: the arc-shaped first wall surface 3*c* that has the same diameter as the inner diameter of the circular waveguide 1; the arc-shaped second wall surface 3*d* that faces the first wall surface 3*c* and has the same diameter as the inner diameter of the circular waveguide 1; the first inclined surface 3*a*; and the second inclined surface 3*b*, and the diameters of the arcs of the first wall surface 3*c* and the second wall surface 3*d* increase from the circular waveguide 1 side to the quadrangular waveguide 2 side. Also even in such a structure, a distance between the centers of the facing arcs of the first wall surface 3*c* and the second wall surface 3*d* is easily kept constant, similarly to the first wall surface 3*c* and the second wall surface 3*d* illustrated in FIGS. 5(*b*) to 5(*d*).

The conductor wall 4 has a rectangular shape so far; however, as long as a large step is not generated at a connecting part which is located between the circular waveguide 1 and the connector waveguide 3, and at which the conductor wall 4 is formed, the polarization coupler according to Embodiment 1 can be implemented. That is, it can be said that even a polarization coupler in which the long side of the quadrangular waveguide 2 is shorter than the inner diameter of the circular waveguide 1 is included in the polarization coupler according to Embodiment 1. Such a case will be described with reference to FIG. 6. In the polarization coupler described with reference to FIG. 6, the conductor wall 4 has a rectangular shape in one and the other of the circular waveguide 1, and has a trapezoid shape in one and the other surface of the connector waveguide 3.

FIGS. 6(*a*) to 6(*g*) correspond to the aforementioned FIGS. 5(*a*) to 5(*g*), respectively. In the polarization coupler illustrated in FIG. 6, there is shown the one in which the inner diameter (a) of the circular waveguide 1 is longer than the length (b) of the long side of the quadrangular waveguide 2. From FIG. 6(*a*) and FIGS. 6(*b*) to 6(*d*), it is understood that the connector waveguide 3 has an oval-type sectional-shape formed by cutting out the upper and lower parts of the circle (circular waveguide 1) shown in FIG. 6(*b*) along parallel lines, and that at the part where the connector waveguide is connected to the circular waveguide 1, an interval between the upper and lower parallel lines varies while the first wall surface 3*c* and second wall surface 3*d* come closer to each other (FIGS. 6(*c*) and 6(*d*)). Accordingly, the connector waveguide 3 is configured at the part connected to the circular waveguide 1 by: the arc-shaped first wall surface 3*c*; the arc-shaped second wall surface 3*d* that faces the first wall surface 3*c*; the first inclined surface 3*a*; and the second inclined surface 3*b*, and the distance between the first wall surface 3*c* and the second wall surface 3*d* becomes narrower from the circular waveguide 1 side to the quadrangular waveguide 2 side (FIGS. 6(*c*) and 6(*d*)). Consequently, one surface and the other surface of the conductor wall 4 is formed in a trapezoid shape in the connector waveguide 3.

That is, from FIG. 6(*a*) and FIGS. 6(*b*) to 6(*d*), it can be said that the connector waveguide 3 is configured at the part connected to the circular waveguide 1 by: the arc-shaped first wall surface 3*c* that has the same diameter as the inner diameter of the circular waveguide 1; the arc-shaped second wall surface 3*d* that faces the first wall surface 3*c* and has the same diameter as the inner diameter of the circular waveguide 1; the first inclined surface 3*a*; and the second inclined surface 3*b*, and the distance between the first wall surface 3*c* and the second wall surface 3*d* becomes narrower from the circular waveguide 1 to the quadrangular waveguide 2. Accordingly, the conductor wall 4 is formed over the connector waveguide 3 and the circular waveguide 1 in a manner to bridge the centers of the facing arcs of the first wall surface 3*c* and the second wall surface 3*d* (connect the centers of the arcs), so that the conductor wall 4 can be formed in a flat plate having a shape combining a rectangular shape with a trapezoid shape instead of the one having a stepped outer shape. Moreover, although not shown in the figures, in the polarization coupler, in a case where the inner diameter (a) of the circular waveguide 1 is shorter than the length (b) of the long side of the quadrangular waveguide 2, that is, $b=a+\alpha$, and the aforementioned $\alpha$ exceeds a permissible range, the connector waveguide 3 may be configured at the part connected to the circular waveguide 1 by: the arc-shaped first wall surface 3*c* that has the same diameter as the inner diameter of the circular waveguide 1; the arc-shaped second wall surface 3*d* that faces the first wall surface 3*c* and has the same diameter as the inner diameter of the circular waveguide 1; the first inclined surface 3*a*; and the second inclined surface 3*b*, and the distance between the first wall surface 3*c* and the second wall surface 3*d* becomes larger from the circular waveguide 1 side to the quadrangular waveguide 2 side. In this case, in the diameter related to the first wall surface 3*c* and the second wall surface 3*d* in the connector waveguide 3, the diameter of the part in contact with the quadrangular waveguide 2 or its neighboring diameter may be longer or shorter than the length of the long side of the quadrangular waveguide 2; however, the difference therebetween is required to be within the range of $\alpha$ mentioned previously.

Though in FIGS. 6(*b*) to 6(*d*), there is illustrated the configuration in which the first wall surface 3*c* and the second wall surface 3*d* have the same shape along the coaxial direction, a description will be given of a case where the conductor wall 4 can have the flat plate having a shape combining a rectangular shape with a trapezoid shape instead of the one having a stepped outer shape, even when the first wall surface 3*c* and the second wall surface 3*d* are formed over the connector waveguide 3 and circular waveguide 1, not having the same shape along the coaxial direction, and even when they with reference to FIG. 6(*a*) and FIGS. 6(*e*) to 6(*g*).

In FIGS. 6(*e*) to 6(*g*), the connector waveguide 3 is configured at the part connected to the circular waveguide 1 by: the arc-shaped first wall surface 3*c* that has the same diameter as the inner diameter of the circular waveguide 1; the arc-shaped second wall surface 3*d* that faces the first wall surface 3*c* and has the same diameter as the inner diameter of the circular waveguide 1; the first inclined surface 3*a*; and the second inclined surface 3*b*, and the distance between the first wall surface 3*c* and the second wall surface 3*d* becomes narrower, and also the diameters of the arcs of the first wall surface 3*c* and the second wall surface 3*d* increase from the circular waveguide 1 side to the quadrangular waveguide 2 side. Also in such a structure, it becomes easy that a reduction ratio of the distance between the centers of the facing arcs of the first wall surface 3*c* and the second wall surface 3*d* is performed similarly to that of the first wall surface 3*c* and the second wall surface 3*d* illustrated in FIGS. 6(*b*) to 6(*d*). Additionally, although not shown in the figures, in the polarization coupler, in a case where the inner diameter (a) of the circular waveguide 1 is shorter than the length (b) of the long side of the quadrangular waveguide 2, that is, $b=a+\alpha$, and the aforementioned a exceeds a permissible range, the connector waveguide 3 should be configured at the part connected to the circular waveguide 1 by: the arc-shaped first wall surface 3*c* that has the same diameter as the inner diameter of the circular waveguide 1; the arc-shaped second wall surface 3*d* that faces the first wall surface 3*c* and has the same diameter as the inner diameter of the circular waveguide 1; the first inclined surface 3*a*; and the second inclined surface 3*b*, and the distance between the first wall surface 3*c* and the second wall surface 3*d* becomes larger from the circular waveguide 1 to the quadrangular waveguide 2, and also the diameters of the arcs of the first wall surface 3*c* and the second wall surface 3*d* increase from the circular waveguide 1 to the quadrangular waveguide 2. In this case, in the diameter related to the first wall surface 3*c* and the second wall surface 3*d* in the connector waveguide 3, the diameter of the part in contact with the quadrangular waveguide 2 or its neighboring diameter may be longer or shorter than the length of the long side of the quadrangular waveguide 2; however, the difference therebetween is required to be within the range of α mentioned previously.

Next, an operation of the polarization coupler according to Embodiment 1 will be described. The polarization coupler according to Embodiment 1 is configured by: the quadrangular sub waveguide 6 that is connected to the circular main waveguide 1 capable of transmitting orthogonally polarized waves via the coupling hole 5 in the radial direction; and the quadrangular waveguide 2 that is connected to the circular main waveguide 1 via the connector waveguide 3 in the coaxial direction. The connector waveguide 3 has an oval cross section formed by cutting out the upper and lower parts of the circular waveguide 1 along parallel lines, the heights of the upper and lower parts vary corresponding to its tapered shape, and there is provided with the conductor wall (septum plate) 4 arranged at an area that extends over the circular waveguide 1 and the connector waveguide 3.

The circular waveguide 1 transmits orthogonally polarized waves, and transmits radio waves (electromagnetic waves) to the quadrangular waveguide 2 via the connector waveguide 3, or to the quadrangular sub waveguide 6 via the coupling hole 5. In addition, the radio waves from the quadrangular waveguide 2 are output to the end of the circular waveguide 1. The radio waves from the quadrangular sub waveguide 6 are output to the end of the circular waveguide 1. The connector waveguide 3 performs matching between the circular waveguide 1 and the quadrangular waveguide 2.

From such a structure, for example, as shown in FIG. 7 (quadrangular waveguide 2 is not connected), the connector waveguide 3 is formed in the aforementioned oval, so that the width (or diameter) of the waveguide is not changed within the range where the outer shape is a circle; thus, the thin flat septum plate (conductor wall) 4 can be easily arranged or processed to extend over the circular waveguide 1 and the connector waveguide 3. In the range where the outer shape is the circle, the change in the width (or diameter) of the waveguide is small, and therefore the thin flat septum plate (conductor wall) 4 can be easily arranged or processed to extend over the circular waveguide 1 and the connector waveguide 3.

Embodiment 2

Figure 11:
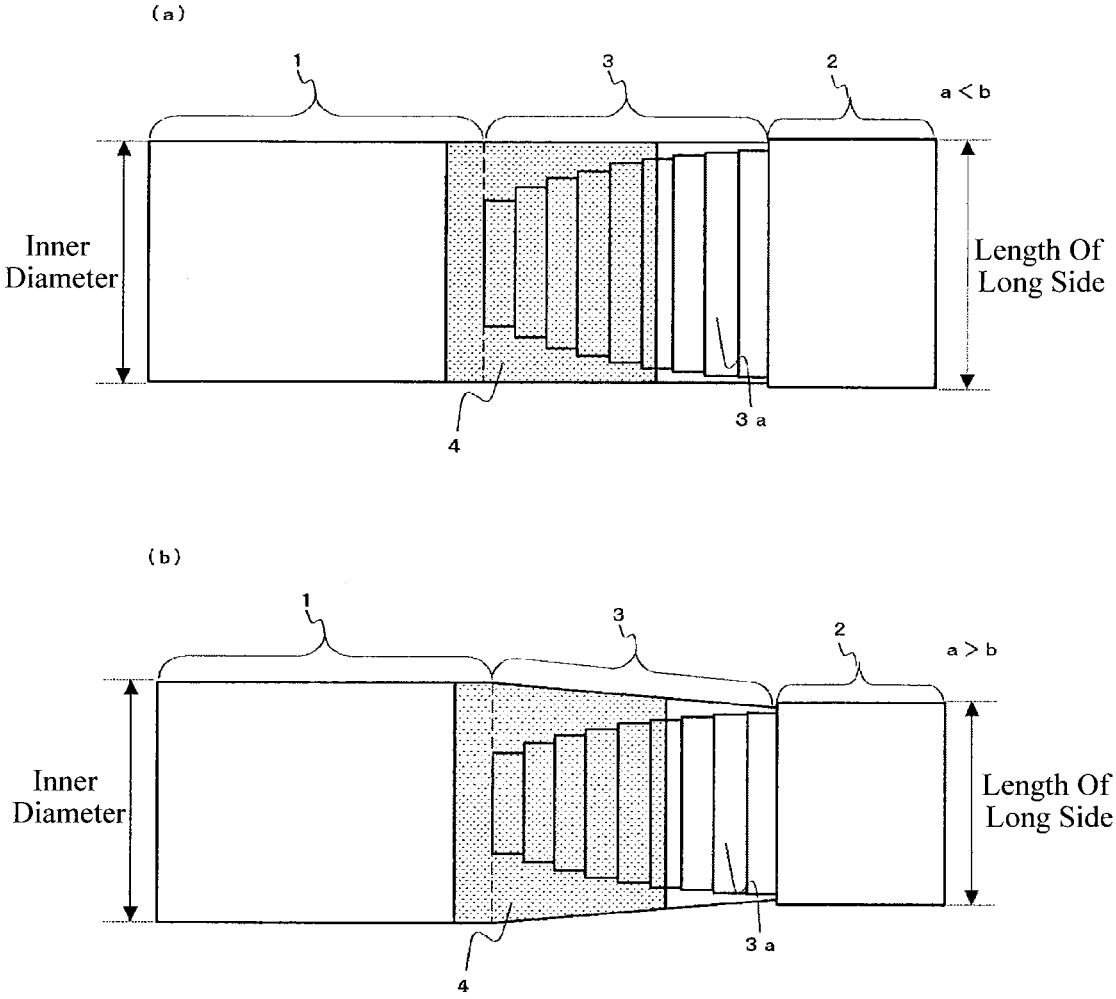
FIG. 11 is perspective top views of the polarization coupler according to Embodiment 2 of this invention.
Figure 12:
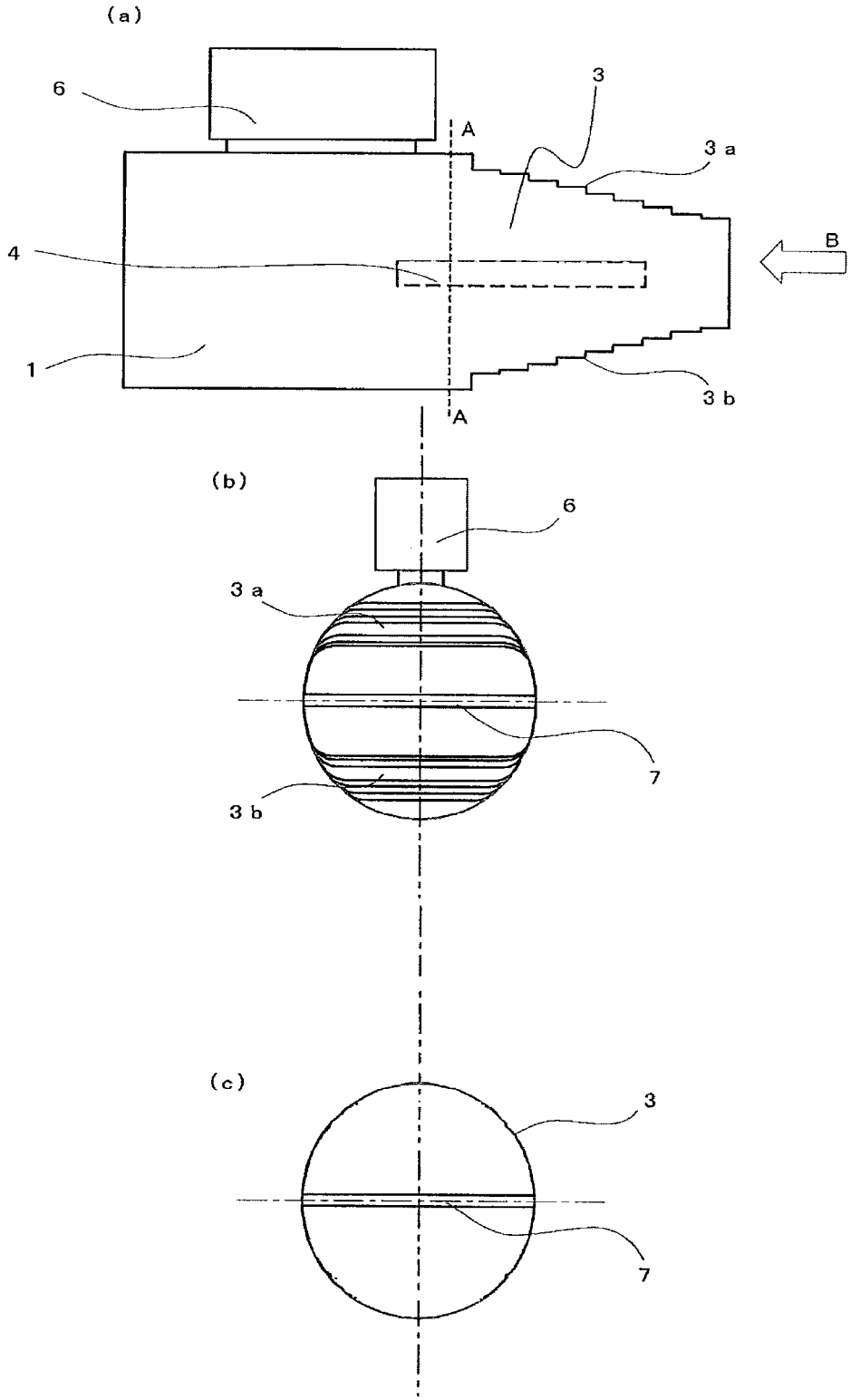
FIG. 12 is a perspective side view, a side view, and a sectional view of the polarization coupler according to Embodiment 2 of this invention.

Embodiment 2 of this invention will be described with reference to FIG. 8 to FIG. 12. FIG. 9(*a*) is a perspective side view (representing a conductor wall (septum plate) by a dotted line) of a polarization coupler, and FIG. 9(*b*) is a side view of the polarization coupler as viewed from an arrow B shown in FIG. 9(*a*). FIG. 11(*a*) is a perspective top view (a coupling hole and a quadrangular sub waveguide are omitted) of the polarization coupler, and FIG. 11(*b*) is a perspective top view (the coupling hole and the quadrangular sub waveguide are omitted) of the polarization coupler. FIG. 12(*a*) is a perspective side view (representing the conductor wall (septum plate) by a dotted line) of the polarization coupler, FIG. 12(*b*) is a side view of the polarization coupler as viewed from an arrow B shown in FIG. 12(*a*), and FIG. 12(*c*) is a sectional view of the polarization coupler taken along a dotted line AA in FIG. 12(*a*). In the figures, the same reference numerals denote the same or corresponding parts, and detailed description thereof will be omitted.

With reference to FIG. 8 to FIG. 12, a polarization coupler according to Embodiment 2 will be described. In Embodiment 2, while points (a first inclined surface 3*a*, and a second inclined surface 3*b*) different from those of Embodiment 1 will be described, description of parts in common with Embodiment 1 will be omitted. The polarization coupler according to Embodiment 2 is different from the polarization coupler according to Embodiment 1 in that the first inclined surface 3*a* and the second inclined surface 3*b* in Embodiment 2 each have a stepwise shape, while the first inclined surface 3*a* and the second inclined surface 3*b* in Embodiment 1 each have a linearly inclined (tapered) surface or have a curved shape defined by a trigonometric function such as a cosine and a sine. The stepwise inclination of the first inclined surface 3*a* and the second inclined surface 3*b* is simulated by the inclined surfaces of the first inclined surface 3*a* and the second inclined surface 3*b* in Embodiment 1. Specifically, when stepped portions of the first inclined surface 3*a* and the second inclined surface 3*b* are connected one by one with straight lines or curved lines, a contour shape thereof is approximated to the first inclined surface 3*a* and the second inclined surface 3*b* in Embodiment 1.

Figure 8:
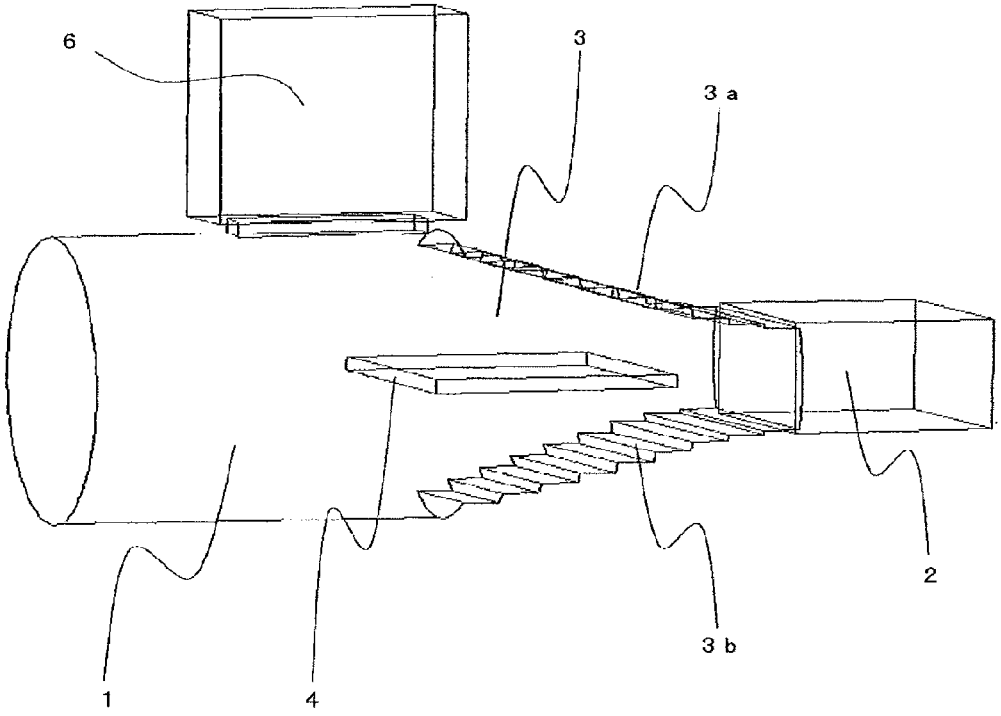
FIG. 8 is a perspective view (single view drawing) of a polarization coupler according to Embodiment 2 of this invention.
Figure 9:
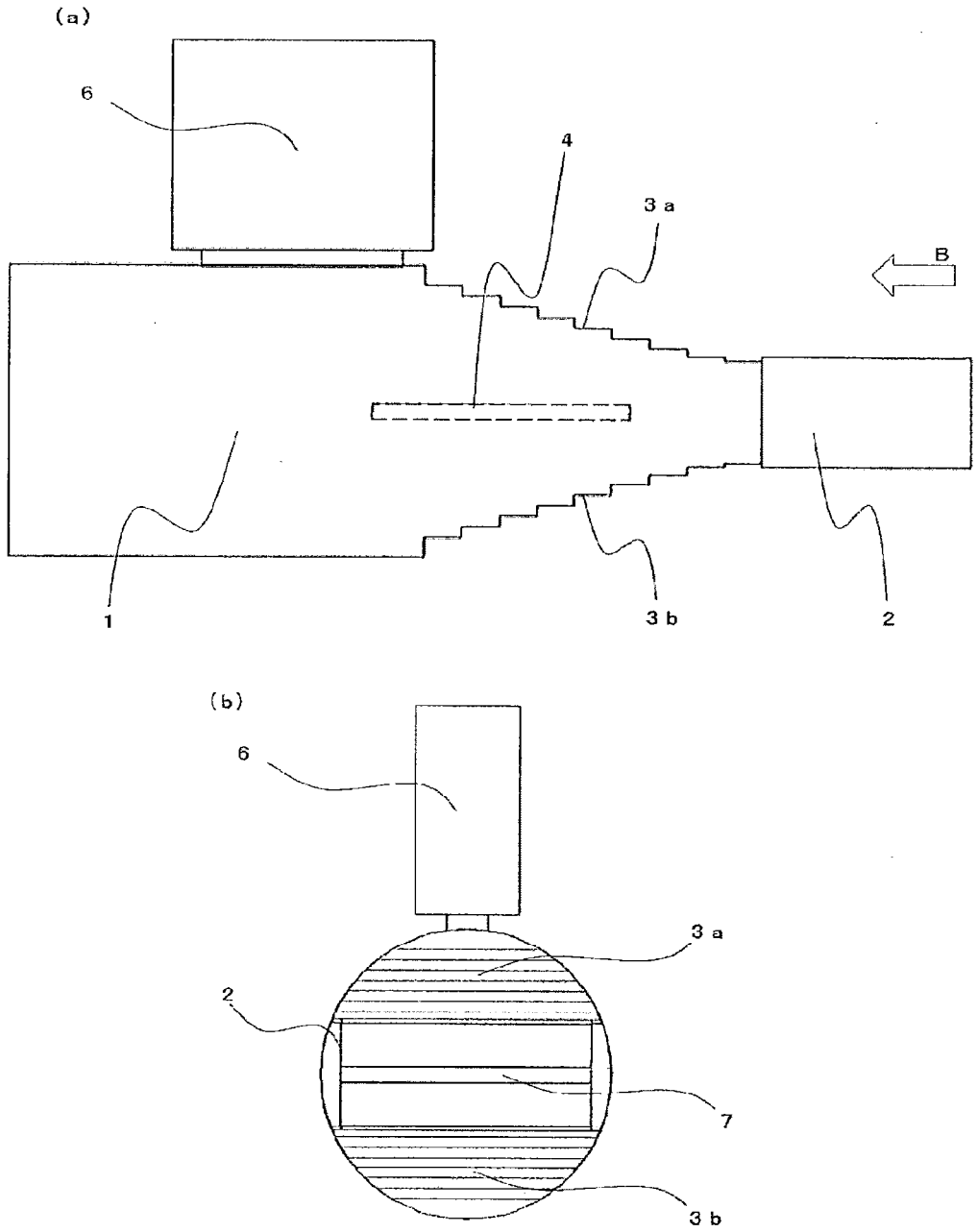
FIG. 9 is a perspective side view and a side view of the polarization coupler according to Embodiment 2 of this invention.
Figure 10:
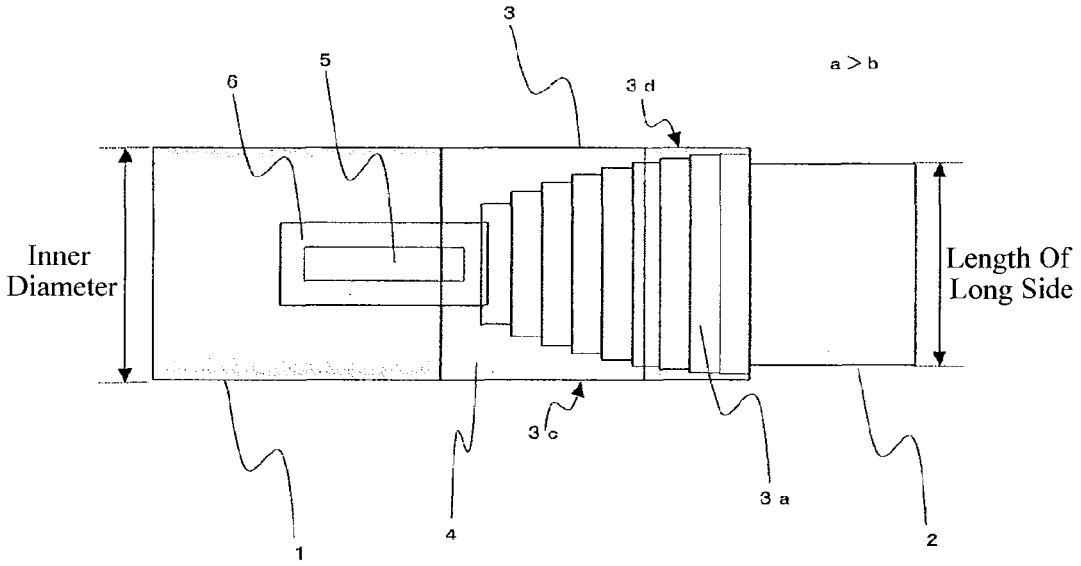
FIG. 10 is a perspective top view of the polarization coupler according to Embodiment 2 of this invention.

FIG. 8 to FIG. 10 correspond to FIG. 2 to FIG. 4 that are used in the description of the polarization coupler according to Embodiment 1. In FIG. 8 to FIG. 10, there is illustrated the one in which a circular waveguide 1 is connected to a connector waveguide 3 that has the first inclined surface 3*a* and the second inclined surface 3*b* with pyramidal steps on hyperbolic parts of the surfaces having a hyperbolic outer shape like an oval divided in a coaxial direction. The first inclined surface 3*a* and the second inclined surface 3*b* each have a stepwise shape that is simulated by a linearly inclined (tapered) surface or a curved shape defined by a trigonometric function such as a cosine and a sine, which is adapted to be easily processed. Note that the stepwise shape may be simulated by a linear inclination or a curved shape defined by a trigonometric function or the like as stated above, or a stepwise shape may be formed by an impedance matching device like a quarter wavelength matching device. Here, it goes without saying that the quarter wavelength corresponds to a frequency (wavelength) to be used in the polarization coupler (waveguide).

FIG. 11(*a*) and FIG. 11(*b*) correspond to FIG. 5(*a*) and FIG. 6(*a*) used in the description of the polarization coupler according to Embodiment 1, respectively. From FIG. 11, it is understood that also in the polarization coupler according to Embodiment 2, both of a rectangular shape, and a shape combining a rectangular shape with a trapezoid shape are allowed in the shape of the conductor wall 4.

Accordingly, it goes without saying that the polarization coupler according to Embodiment 2 is configured by: a quadrangular sub waveguide 6 that is connected to the circular main waveguide 1 that is capable of transmitting orthogonally polarized waves via a coupling hole in the radial direction; and a quadrangular waveguide 2 that is connected to the circular main waveguide 1 via the connector waveguide 3 in the axial direction, similarly to the polarization coupler according to Embodiment 1. A difference between Embodiment 2 and Embodiment 1 is that the polarization coupler according to Embodiment 2 has an oval cross section formed by cutting out the upper and lower parts of the connector waveguide 3 along parallel lines, and the heights of the upper and lower parts vary in a stepped shape (stepwise).

Embodiments 1 and 2

In the polarization coupler according to each of the Embodiments 1 and 2, it is preferable that the circular waveguide 1 and the connector waveguide 3 are molded integrally by a general machining method such as cutting method and die casting. It is preferable that the conductor wall 4 is also molded integrally with the circular waveguide 1 and the connector waveguide 3 by a general machining method such as cutting method and die casting. Additionally, a general waveguide connection method may be employed for the connection of the connector waveguide 3 and the quadrangular waveguide 2.

In a case where the circular waveguide 1 and the connector waveguide 3 are formed integrally, in Embodiment 1, the connector waveguide 3 can be understood as a tapered conversion part provided on the end on the side that is connected to the quadrangular waveguide 2 of the circular waveguide 1, and the conductor wall (septum plate) 4 is arranged on an area extending over the circular waveguide 1 and the tapered conversion part of the circular waveguide 1. In Embodiment 2, the connector waveguide 3 can be understood as a step conversion part provided on the end on the side that is connected to the quadrangular waveguide 2 of the circular waveguide 1, and the conductor wall (septum plate) 4 is arranged on an area extending over the circular waveguide 1 and the step conversion part of the circular waveguide 1.

In each of Embodiments 1 and 2, the following is described: the circular waveguide 1 has a substantially perfect circular shape, and the constant inner diameter over the circumference, and the length of the long side of the quadrangular waveguide 2 is substantially the same as the inner diameter of the circular waveguide 1 (difference in diameter that is within the range of $\alpha$ mentioned previously), or shorter than the inner diameter of the circular waveguide 1 (difference in diameter that exceeds $\alpha$ mentioned previously); however, in a case where the circular waveguide 1 is formed in an ellipse, when the circular waveguide 1 and the quadrangular waveguide 2 are connected (of course, when connected via the connector waveguide 3) such that the longer part of the inner diameters matches the long side of the quadrangular waveguide 2, and the shorter part thereof matches the long side of the quadrangular waveguide 2, the polarization coupler according to each of Embodiments 1 and 2 is applicable thereto. Specifically, the structure of the conductor wall (septum plate) 4 of the polarization coupler in the invention according to the present application can be reproduced, and therefore the polarization coupler according to each of Embodiments 1 and 2 is applicable thereto. Accordingly, it is apparent not to depart from the spirit of the invention according to this application.

That is, it can be said that the polarization coupler according to this application (Embodiments 1 and 2) includes: the circular waveguide 1; the connector waveguide 3 that communicates with (connected to, or formed integrally with) one of openings of the circular waveguide 1 (when it is formed integrally with the circular waveguide 1, the connector waveguide 3 becomes the tapered conversion part of the circular waveguide 1 or the step conversion part of the circular waveguide 1 as mentioned above); the flat conductor wall 4 formed over the connector waveguide 3 and the circular waveguide 1, and dividing the inside of the circular waveguide 1 and the connector waveguide 3; the first inclined surface 3*a* that is formed on the inner wall of the connector waveguide 3 at a position facing one surface of the conductor wall 4, and inclined toward the conductor wall 4 as coming closer to the side opposite to the circular waveguide 1; the second inclined surface 3*b* that is formed on the inner wall of the connector waveguide 3 at a position facing on the other surface of the conductor wall 4, and inclined toward the conductor wall 4 as coming closer to the side opposite to the circular waveguide 1; and the coupling hole 5 that is formed in the circular waveguide 1, and extracts one that is polarization-divided by the conductor wall 4 out of electromagnetic waves propagated through the circular waveguide 1. Accordingly, the shape (cross section) of the part communicating with the circular waveguide 1 of the connector waveguide 3 is the same (a circle or an ellipse) as the sectional shape of the circular waveguide 1. In addition, the shape (cross section) of the side, connectable to the quadrangular waveguide 2, of the connector waveguide 3 is an ellipse, or a quadrangle with arc-shaped corners (four corners). Note that the conductor wall 4 is arranged parallel to the direction in which the long side of the quadrangular waveguide 2 extends, and which is connectable to the connector waveguide 3 (circular waveguide 1). The tapered conversion part of the circular waveguide 1, or the step conversion part of the circular waveguide 1 is formed on the side of the quadrangular waveguide 2 which is connectable to the circular waveguide 1.

It is noted that the present invention can be implemented by a free combination of the embodiments, a modification of arbitrary components of the embodiments, or an omission of arbitrary components of the embodiments, within the scope of the invention.

INDUSTRIAL APPLICABILITY

The polarization coupler according to this invention includes: the connector waveguide that is arranged in the axial direction of the circular waveguide, and connects a quadrangular waveguide having the short side shorter than the inner diameter of the circular waveguide with the circular waveguide; the flat conductor wall that is formed over the connector waveguide and the circular waveguide, and divides the inside of the circular waveguide arranged parallel to the direction where the long side of the quadrangular waveguide extends; the first inclined surface that is formed on the inner wall of the connector waveguide at the position facing one surface of the conductor wall, and inclined toward the conductor wall as coming closer to the quadrangular waveguide; the second inclined surface that is formed on the inner wall of the connector waveguide at the position facing the other surface of the conductor wall, and inclined toward the conductor wall as coming closer to the quadrangular waveguide; and the coupling hole that is formed in the circular waveguide, and extracts one that is poralization-divided by the conductor wall out of the electromagnetic waves propagated through the circular waveguide, and thus the conductor wall (septum plate) is easily provided in production, and the range where the length of the septum plate can be adjusted becomes wider, so that the improvement in electric performance such as bandwidth widening can be achieved. Therefore, it is suitable for a polarization coupler that separates orthogonally polarized waves.

EXPLANATIONS OF REFERENCE NUMERALS

1 Circular waveguide (circular main waveguide),
2 Quadrangular waveguide (rectangular waveguide, quadrangular main waveguide, rectangular main waveguide, coaxial-side quadrangular sub waveguide),
3 Connector waveguide,
3*a* First inclined surface,
3*b* Second inclined surface,
3*c* First wall surface,
3*d* Second wall surface,
4 Conductor wall (septum plate, short circuit plate),
5 Coupling hole,
6 Quadrangular sub waveguide (rectangular sub waveguide, orthogonal-side rectangular sub waveguide).

The invention claimed is:

1. A polarization coupler comprising:
a circular waveguide;
a quadrangular waveguide that is arranged in an axial direction of the circular waveguide, and has a short side shorter than an inner diameter of the circular waveguide;
a connector waveguide that connects the quadrangular waveguide with the circular waveguide;
a flat conductor wall that is formed over the connector waveguide and the circular waveguide, and divides the inside of the connector waveguide and the circular waveguide arranged parallel to a direction where a long side of the quadrangular waveguide extends;
a first inclined surface that is formed on an inner wall of the connector waveguide at a position facing one surface of the conductor wall, and inclined toward the conductor wall as coming closer to the quadrangular waveguide;
a second inclined surface that is formed on the inner wall of the connector waveguide at a position facing the other surface of the conductor wall, and inclined toward the conductor wall as coming closer to the quadrangular waveguide; and
a coupling hole that is formed in the circular waveguide, and extracts one that is polarization-divided by the conductor wall out of electromagnetic waves propagated through the circular waveguide,
wherein the connector waveguide is configured by: an arc-shaped first wall surface; an arc-shaped second wall surface that faces the first wall surface; the first inclined surface; and the second inclined surface.

2. The polarization coupler according to claim 1, wherein the first inclined surface and the second inclined surface each have a stepwise shape.

3. The polarization coupler according to claim 1, wherein the connector waveguide is configured by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface.

4. The polarization coupler according to claim 1, wherein the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein the first wall surface and the second wall surface each have a diameter that increases from the circular waveguide side toward the quadrangular waveguide side.

5. The polarization coupler according to claim 1, wherein the long side of the quadrangular waveguide is shorter than the inner diameter of the circular waveguide.

6. The polarization coupler according to claim 1, wherein the one surface and the other surface of the conductor wall in the connector waveguide each are formed in a trapezoid shape.

7. The polarization coupler according to claim 5, wherein the connector waveguide is configured at a part connected to the circular waveguide by: an arc-shaped first wall surface; an arc-shaped second wall surface that faces the first wall surface; the first inclined surface; and the second inclined surface, wherein a distance between the first wall surface and the second wall surface decreases from the circular waveguide side toward the quadrangular waveguide side.

8. The polarization coupler according to claim 6, wherein the connector waveguide is configured at a part connected to the circular waveguide by: an arc-shaped first wall surface; an arc-shaped second wall surface that faces the first wall surface; the first inclined surface; and the second inclined surface, wherein a distance between the first wall surface and the second wall surface decreases from the circular waveguide side toward the quadrangular waveguide side.

9. The polarization coupler according to claim 5, wherein the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein a distance between the first wall surface and the second wall surface decreases from the circular waveguide side toward the quadrangular waveguide side.

10. The polarization coupler according to claim 6, wherein the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein a distance between the first wall surface and the second wall surface decreases from the circular waveguide side toward the quadrangular waveguide side.

11. The polarization coupler according to claim 5, wherein the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein a distance between the first wall surface and the second wall surface decreases, and also the first wall surface and the second wall surface each have a diameter that increases, from the circular waveguide side toward the quadrangular waveguide side.

12. The polarization coupler according to claim 6, wherein the connector waveguide is configured at a part connected to the circular waveguide by: an arc-shaped first wall surface that has the same diameter as the inner diameter of the circular waveguide; an arc-shaped second wall surface that faces the first wall surface and has the same diameter as the inner diameter of the circular waveguide; the first inclined surface; and the second inclined surface, wherein a distance between the first wall surface and the second wall surface decreases, and also the first wall surface and the second wall surface each have a diameter that increases, from the circular waveguide side toward the quadrangular waveguide side.

13. The polarization coupler according to claim 1, wherein the conductor wall is formed integrally with the circular waveguide and the quadrangular waveguide.

14. The polarization coupler according to claim 1, wherein the quadrangular waveguide has a long side longer than the inner diameter of the circular waveguide, and a distance between the first wall surface and the second wall surface of the connector waveguide increases from the circular waveguide side to the quadrangular waveguide.

15. The polarization coupler according to claim 1, wherein the quadrangular waveguide has a long side longer than the inner diameter of the circular waveguide, and at a part where the connector waveguide is connected with the circular waveguide, the first wall surface and the second wall surface each are formed in an arc-shape having the same diameter as the inner diameter of the circular waveguide, and a distance between the first wall surface and the second wall surface increases from the circular waveguide side to the quadrangular waveguide.

* * * * *